US010166573B2

(12) United States Patent
Karcz

(10) Patent No.: US 10,166,573 B2
(45) Date of Patent: Jan. 1, 2019

(54) ECCENTRIC ASSEMBLY FOR A VIBRATION COMPACTING MACHINE

(71) Applicant: VOLVO CONSTRUCTION EQUIPMENT AB, Eskilstuna (SE)

(72) Inventor: Maciej Karcz, Losiow (PL)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 15/776,037

(22) PCT Filed: Dec. 28, 2015

(86) PCT No.: PCT/EP2015/081277
§ 371 (c)(1),
(2) Date: May 14, 2018

(87) PCT Pub. No.: WO2017/114546
PCT Pub. Date: Jul. 6, 2017

(65) Prior Publication Data

US 2018/0326457 A1 Nov. 15, 2018

(51) Int. Cl.
*E01C 19/28* (2006.01)
*B06B 1/16* (2006.01)

(52) U.S. Cl.
CPC ..... *B06B 1/164* (2013.01); *E01C 19/286* (2013.01)

(58) Field of Classification Search
CPC ..... E01C 19/28; E01C 19/286; B06B 1/164
USPC ..... 404/117, 130
See application file for complete search history.

(56) References Cited

U.S. PATENT DOCUMENTS 3,783,701 A * 1/1974 Steprath ..... B06B 1/186 74/87
3,896,677 A * 7/1975 Larson ..... B06B 1/162 74/61
4,342,523 A * 8/1982 Salani ..... E01C 19/286 366/116
6,585,450 B2 7/2003 Meyers et al.
7,059,802 B1 * 6/2006 Geier ..... E01C 19/286 404/117
7,270,025 B2 9/2007 Niglov
(Continued)

OTHER PUBLICATIONS

International Search Report (dated Feb. 22, 2016) for corresponding International App.PCT/EP2015/081277.

*Primary Examiner* — Gary S Hartmann
(74) *Attorney, Agent, or Firm* — WRB-IP LLP

(57) ABSTRACT

An eccentric assembly controlled by a rotational speed thereof. The eccentric assembly includes: a housing driven and rotated by a motor; an eccentric shaft installed in the housing to have a changeable angular position by rotating relative to the housing; a locking device adopted to lock the eccentric shaft by engaging with one side of the eccentric shaft and to unlock the eccentric shaft when a rotational speed of the housing is greater than a locking critical speed; a clamping device adopted to clamp an opposite side of the one side of the eccentric shaft that engages with the locking device and to release clamping to the eccentric when a rotational speed of the housing is greater than a clamping critical speed; and a stopper installed in the housing so as to limit a rotation angle of the eccentric shaft generated when locking and clamping to the eccentric shaft are released.

10 Claims, 5 Drawing Sheets

(56) References Cited

U.S. PATENT DOCUMENTS 8,998,530 B2 * 4/2015 Buschmann ..... E01C 19/407
404/84.05
9,790,648 B2 * 10/2017 Buschmann ..... E01C 19/407

* cited by examiner

【FIG. 1】
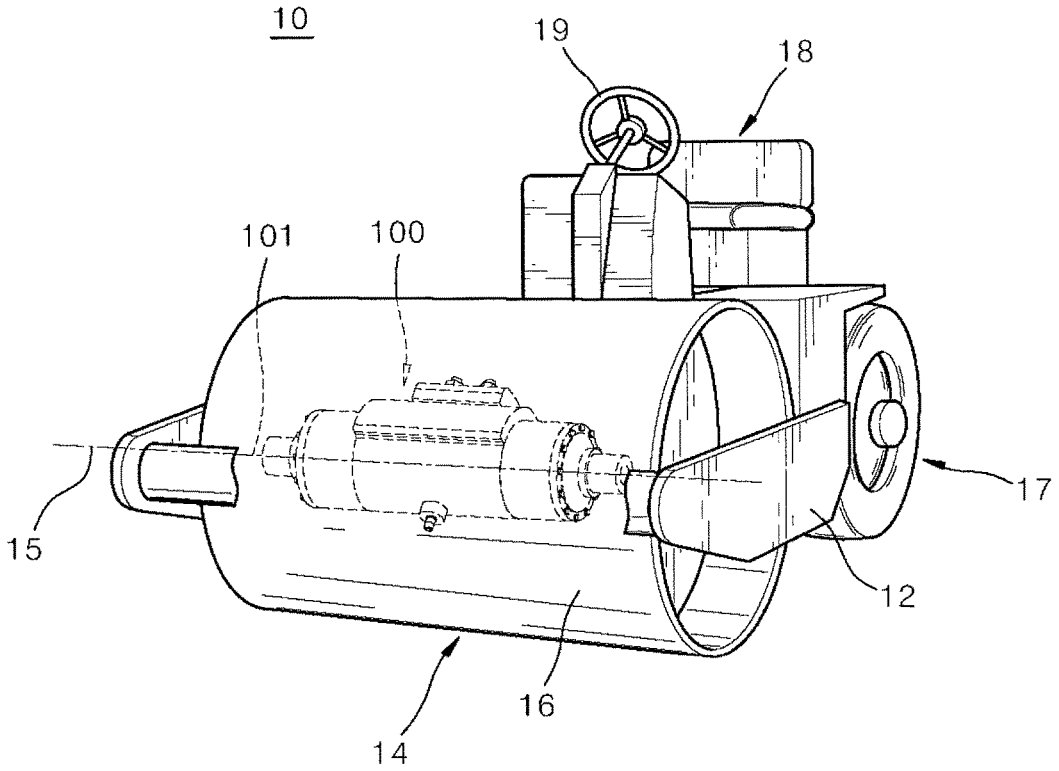

【FIG. 2】
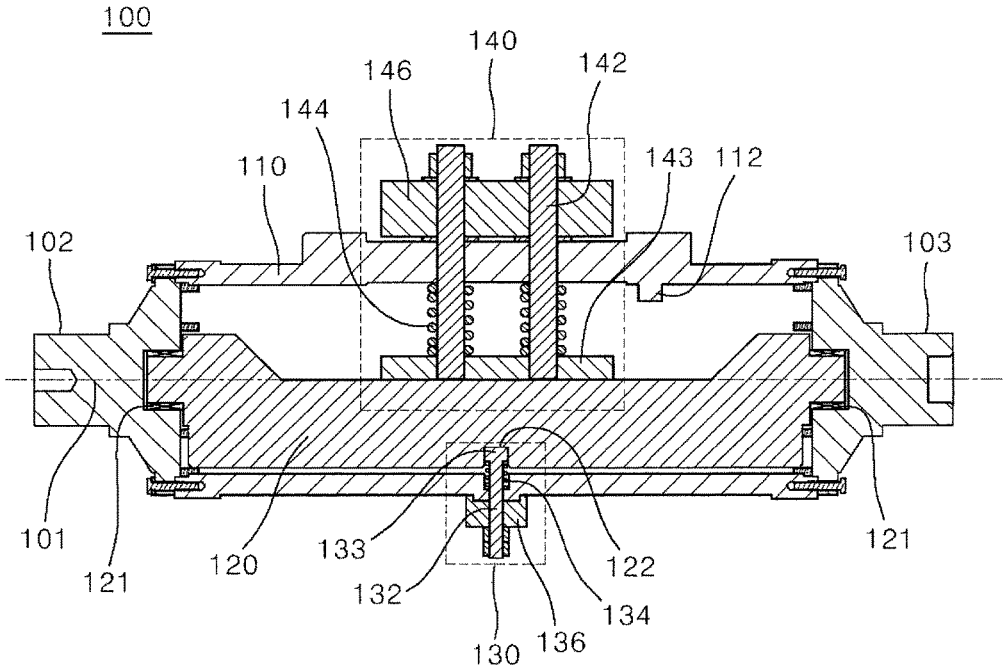

【FIG. 3】
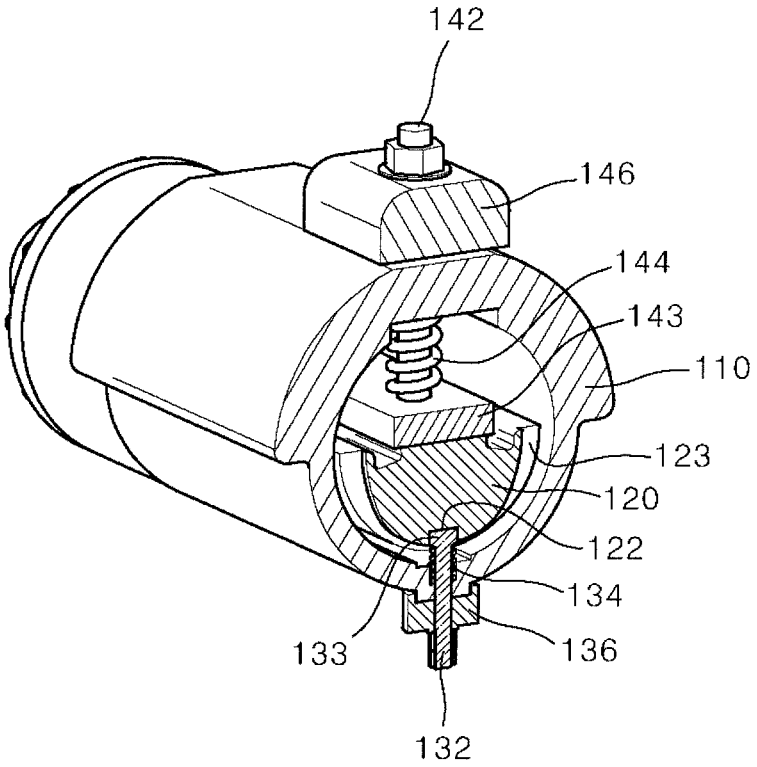

【FIG. 4】
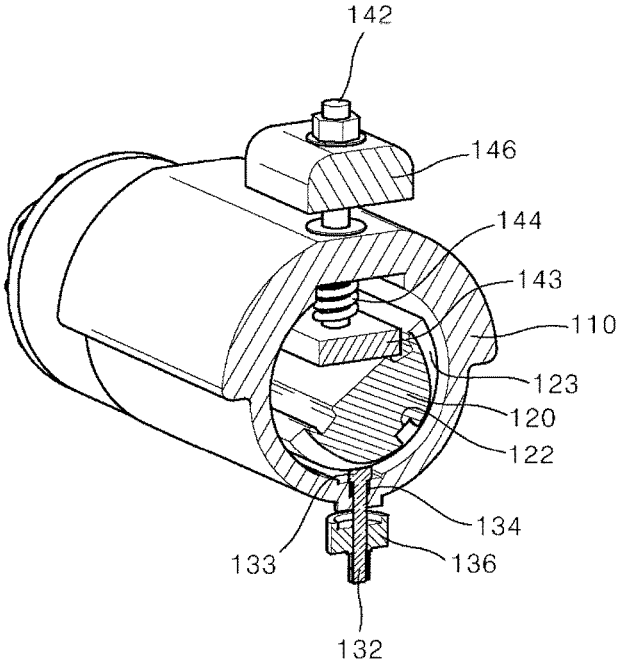
【FIG. 5】
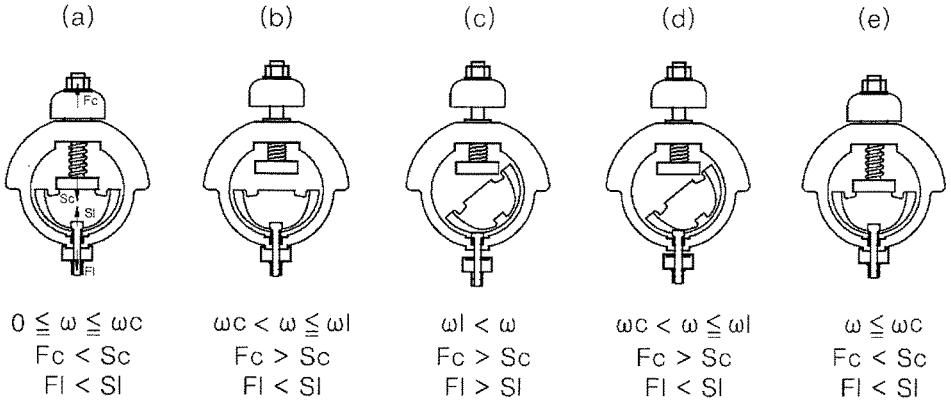

【FIG. 6】
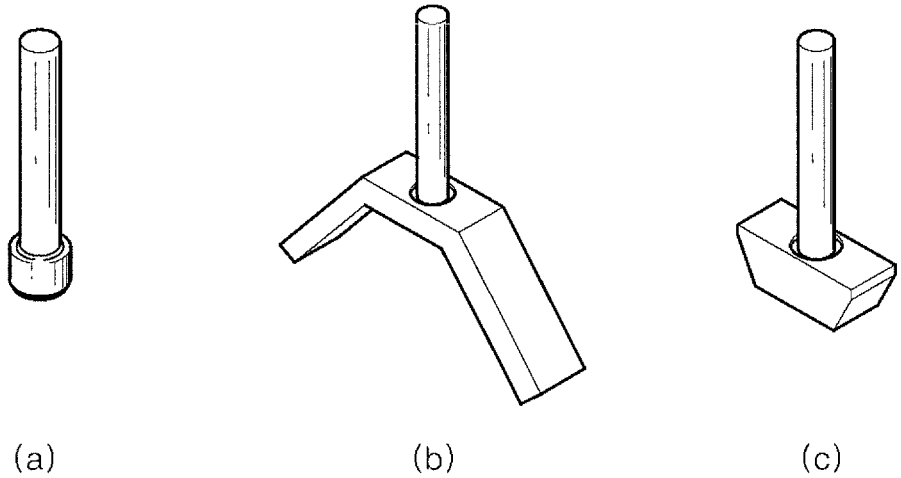

ECCENTRIC ASSEMBLY FOR A VIBRATION COMPACTING MACHINE

BACKGROUND AND SUMMARY

The present disclosure relates to vibration compacting machines, and more particularly to an eccentric assembly for a vibration compacting machine.

Vibration compacting machines are used in leveling paved or unpaved ground surfaces. A typical vibration compacting machine includes an eccentric assembly, which is located inside a drum of a drum assembly of the compacting machine and, while being rotated by an electrical or hydraulic motor, the eccentric assembly generates vibrations due to its eccentricity. Then, the vibrations generated by the eccentric assembly are transferred to the drum assembly, thereby enhancing compacting efficiency of the compacting machine.

As such, eccentricity of an eccentric assembly is essential for generating vibrations through rotation thereof, and higher degree of eccentricity generates higher amplitude of vibration that is desirable when larger compacting power is required. However, eccentricity of an eccentric assembly is not desirable during starting of rotation of the eccentric assembly. During this start-up period, the vibrations generated by the eccentric assembly are not used productively by the vibration compacting machine because vibration compacting machines generally do not start their working pass during this period. Moreover, as eccentricity of the eccentric assembly requires higher start-up torque, which is significantly larger than the torque required for maintaining rotation of the eccentric assembly, a more powerful electrical or hydraulic motor is needed due to eccentricity during the start-up period. In brief, it can be said that eccentricity of an eccentric assembly during the start-up period is not just useless but also undesirable.

On the market, there are solutions that provide systems for controlling eccentricity or an eccentric moment of eccentric assemblies. Examples of such solutions are U.S. Pat. No. 7,270,025 B2, which discloses "Adjusting device for regulating the eccentric moment of a roller drum eccentric shaft", and U.S. Pat. No. 6,585,450 B2 which discloses "Speed controlled eccentric assembly".

However, it is still required to develop an eccentric assembly having a simple and economic structure that is configured such that during a start-up period of the eccentric assembly, the eccentric moment is zero or has a very small value, and then when the eccentric assembly has a sufficient rotational speed by the completion of start-up, sufficient eccentric moment in the eccentric assembly can be provided for working.

According to one aspect of the present disclosure, there is provided an eccentric assembly for a vibration compacting machine controlled by rotational speed thereof. The eccentric assembly includes: a housing driven and rotated by a motor, an eccentric shaft installed in the housing so as to have a changeable angular position by rotating relative to the housing; a locking device adopted to lock the eccentric shaft by engaging with one side of the eccentric shaft, and to unlock the eccentric shaft when a rotational speed of the housing is greater than a predetermined locking critical speed col; a clamping device adopted to clamp an opposite side of the one side of the eccentric shaft that engages with the locking device, and to release clamping to the eccentric shaft when a rotational speed of the housing is greater than a predetermined clamping critical speed coc; and a stopper installed in the housing so as to limit a rotation angle of the eccentric shaft generated when locking and clamping to the eccentric shaft are released.

BRIEF DESCRIPTION OF THE DRAWINGS

FIG. 1 is an isometric view of a vibrating compacting machine including an eccentric assembly according to an embodiment of the present disclosure.

FIG. 2 is a longitudinal section view showing the eccentric assembly according to the embodiment of the present disclosure illustrated in FIG. 1.

FIG. 3 is a perspective view showing a half of the eccentric assembly resulting from laterally cutting the eccentric assembly according to the embodiment of the present disclosure illustrated in FIG. 1, and illustrating the eccentric assembly in Zero state.

FIG. 4 is a perspective view showing a half of the eccentric assembly resulting from laterally cutting the eccentric assembly according to the embodiment of the present disclosure illustrated in FIG. 1, and illustrating the eccentric assembly in Work state.

FIGS. 5(*a*) to 5(*e*) are cross sectional views resulting from laterally cutting the eccentric assembly according to the embodiment of the present disclosure illustrated in FIG. 1, and illustrating state changes according to rotational speed of the eccentric assembly in chronological order.

FIGS. 6(*a*) to 6(*c*) are perspective views showing modified examples of a locking pin illustrated in FIG. 2.

DETAILED DESCRIPTION

Reference will now be made in detail to embodiments of the present disclosure, examples of which are illustrated in the accompanying drawings. While the present disclosure will be described in conjunction with the following embodiments, it will be understood that they are not intended to limit the present disclosure to these embodiments alone. On the contrary, the present disclosure is intended to cover alternatives, modifications, and equivalents that may be included within the spirit and scope of the present disclosure as defined by the appended claims. Furthermore, in the following detailed description of the present disclosure, numerous specific details are set forth in order to provide a thorough understanding of the present disclosure. However, embodiments of the present disclosure may be practiced without these specific details.

FIG. 1 shows a vibration compacting machine 10 according to an embodiment of the present disclosure. The vibration compacting machine 10 is used in leveling paved or unpaved ground surfaces. The vibration compacting machine 10 includes a frame 12 and at least one drum assembly 14 mounted to one end of the frame 12 for rotation about a longitudinal axis IS. The drum assembly 14 includes a drum 16 and an eccentric assembly 100 that is mounted for rotation relative to the drum 16. The eccentric assembly 100 rotates about a rotational axis 101 that is substantially aligned with the longitudinal axis 15 of the drum assembly 14. The eccentric assembly 100 can have an eccentric moment such that rotation of the eccentric assembly 100 by a motor (not shown) creates vibrations that are transferred through the drum 16 to the ground. The opposite end of the frame 12 generally has a wheel assembly 17 or a second drum assembly (not shown) that, with the drum assembly 14, supports the frame 12 for movement over the ground surface. An operator's station 18, including a steering wheel 19 or the like, is provided on the frame 12 for driving and operation of the compacting machine 10.

FIG. 2 is a longitudinal section view showing the eccentric assembly according to the embodiment of the present disclosure illustrated in FIG. 1. As shown in FIG. 2, the preferred eccentric assembly 100 includes two flanged journals 102, 103 at the ends of a housing 110. At least one and preferably only one of the flanged journals 102, 103 is coupled to an electrical or hydraulic motor (not shown) such that the eccentric assembly 100 is rotated by the motor about the rotational axis 101, and thus, generates vibrations that are transferred to the drum 16 when the eccentric assembly 100 has some moment of eccentricity.

An eccentric shaft 120 is installed in the housing 110 to be rotatable relative to the housing 110. In the present embodiment, opposite ends of the eccentric shaft 120 are connected to the two flanged journals 102, 103 via a bearing 121, respectively so that the eccentric shaft 120 is mounted to be rotatable relative to the housing 110. Alternatively, although not shown in the drawings, it is obvious to those having ordinary skill in the art that the eccentric shaft 120 may be fixed in the housing 110 to be rotatable relative to the housing 110 even in such a manner that the eccentric shaft is connected to an inner circumferential surface of the housing via the bearing. Furthermore, an arbitrary construction wherein a rotational position, i.e., an angular position, of the eccentric shaft 120 relative to the housing 110 may be changed because a relative rotation can be performed between the housing 110 and the eccentric shaft 120 should be understood to be included in the present disclosure.

FIGS. 3 and 4 are perspective views showing a half of the eccentric assembly resulting from laterally cutting the eccentric assembly according to the embodiment of the present disclosure illustrated in FIG. 1. FIG. 3 illustrates the eccentric assembly in Zero state and FIG. 4 illustrates the eccentric assembly in Work state.

As illustrated in FIGS. 2 to 4, a locking device 130 is installed in the housing 110. The locking device 130 is configured such that the locking device 130 engages with one side of the eccentric shaft 120 to prevent the rotation of the eccentric shaft 120 relative to the housing 110, and engagement with the eccentric shaft 120 is released when a rotational speed of the eccentric assembly 100, namely, a rotational speed of the housing 110 is greater than a locking critical speed col, thereby enabling fixation of the eccentric shaft 120 to the housing 110 to be released.

One example of such a locking device 130 is illustrated in FIGS. 2 to 4. The locking device 130 includes: a locking pin 132 installed to be slidable in a radius direction to the rotational axis 101 of the housing 110; a spring means 134 applying a force to the locking pin 132 in a radius direction to the rotational axis 101 of the housing 110; and a counterweight 136 applying a force to the locking pin 132 in a direction opposite to the direction of the force applied by the spring means 134 using a centrifugal force generated when the housing 110 is rotated. A head part 133 is provided at a position corresponding to an end of the locking pin 132 adjacent to the rotational axis 101, and a receiving hole 122 receiving the head part 133 is formed in the eccentric shaft 120 such that the head part is inserted into the receiving hole 133, thereby preventing rotation of the eccentric shaft 120. The locking critical speed col is determined by specifications of the spring means 134 and the counterweight 136 that apply the respective forces to the locking pin 132 in the opposite directions.

A clamping device 140 is also installed in the housing 110. As previously described, when the rotational speed of the housing 110 is not greater than the locking critical speed col, one side of the eccentric shaft 120 engages with the locking device 130 so that rotation of the eccentric shaft 120 relative to the housing 110 is prevented. The clamping device 140 contacts an opposite side of the one side of the eccentric shaft 120 that engages with the locking device 130, thereby applying a pressing force. When the rotational speed of the housing 110 is greater than a predetermined clamping critical speed ooc, the clamping device 140 is spaced apart from the eccentric shaft 120 not to apply the pressing force.

One example of such a clamping device 140 is illustrated in FIGS. 2 to 4. The clamping device 140 includes: a sliding rod 142 installed to be slidable in a radius direction to the rotational axis 101 of the housing 110; a clamping plate 143 installed at a position corresponding to an end of the sliding rod 142 adjacent to the eccentric shaft 120; a spring means 144 applying a force to the sliding rod 142 in a radius direction to the rotational axis 101 of the housing 110; and a counterweight 146 applying a force to the sliding rod 142 in a direction opposite to the direction of the force applied by the spring means 144 using a centrifugal force generated when the housing 110 is rotated. The clamping critical speed ooc is determined by specifications of the spring means 144 and the counterweight 146 that apply the respective forces to the sliding rod in the opposite directions.

In the present disclosure, the state of the eccentric assembly illustrated in FIG. 3 refers to Zero state, and the state of the eccentric assembly illustrated in FIG. 4 refers to Work state. The reason why the state of the eccentric assembly illustrated in FIG. 3 is designated as Zero state is because an eccentric moment of the eccentric assembly 100 has a value smaller than a predetermined value or is preferably zero in the state illustrated in FIG. 3 where the eccentric shaft 120 is locked by the locking device 130 and is clamped by the clamping device 140. In other words, this also means that, in this state, mass distribution of the housing 110, the eccentric shaft 120, the locking device, and the clamping device 140 is performed so that the center of gravity of the eccentric assembly 100 is very close to the rotational axis 101, preferably, the center of gravity of the eccentric assembly 100 is consistent with the rotational axis 101. In this case, the predetermined value represents a value determined in terms of design so that a start-up torque of the eccentric assembly is not greater than a torque required for maintaining rotation of the eccentric assembly.

The reason why the state of the eccentric assembly illustrated in FIG. 4 is designated as Work state is because the eccentric moment of the eccentric assembly 100 is very largely increased, preferably, it is maximally increased, in the state illustrated in FIG. 4 where locking of the locking device 130 to the eccentric shaft 120 is released, and clamping of the clamping device 140 to the eccentric shaft 120 is released such that the eccentric assembly is rotated to a fixed angular position. In other words, this also means that, in this state, mass distribution of the housing 110, the eccentric shaft 120, the locking device 130, and the clamping device 140 is performed so that the center of gravity of the eccentric assembly 100 is very far away from the rotational axis 101, preferably, the center of gravity of the eccentric assembly 100 is maximally far away from the rotational axis 101.

With regard to Work state illustrated in FIG. 4, a member for limiting a rotation angle of the eccentric shaft to the housing 110 is provided. For example, it is preferable to limit the rotation angle such that the eccentric shaft 120 does not rotate any longer after the eccentric shaft 120 has rotated up to a position at which the eccentric moment of the eccentric assembly 100 may be maximally increased. As such, in order to limit the rotation angle, a stopper 112 (see FIG. 2) may be installed at a predetermined position in the housing 110. Alternatively, the clamping plate 143 may serve as a stopper in such a manner that the eccentric shaft 120 is blocked or stopped by the clamping plate 143 of the clamping device 140 so that the rotation angle is limited.

An operation of the embodiment of the present disclosure will be described with reference to FIGS. 5(*a*) to 5(*e*) show state changes according to rotational speed ω of the eccentric assembly 100 in chronological order in the case where the clamping critical speed coc is smaller than the locking critical speed ωĭ. . FIG. 5(*a*) shows the state in which the rotational speed ω of the eccentric assembly 100 is greater than 0 and not greater than the clamping critical speed coc when the eccentric assembly 100 has just started-up. FIG. 5(*b*) shows the state in which the rotational speed co of the eccentric assembly 100 is greater than the clamping critical speed coc and not greater than the locking critical speed col as the rotational speed co of the eccentric assembly 100 increases. FIG. 5(*c*) shows the state in which the rotational speed ω of the eccentric assembly 100 is greater than the locking critical speed col as the rotational speed co of the eccentric assembly 100 further increases. FIG. 5(*d*) shows the state in which the rotational speed ω of the eccentric assembly 100 is greater than the clamping critical speed coc and not greater than the locking critical speed col as the rotational speed ω of the eccentric assembly 100 reduces. FIG. 5(*e*) shows the state in which the rotational speed ω of the eccentric assembly 100 is not greater than the clamping critical speed coc as the rotational speed co of the eccentric assembly 100 further reduces.

In FIG. 5(*a*), Sl represents a spring force of the spring means 134 that acts on the locking pin 132 in a radius direction to the rotational axis 101; Fl represent a centrifugal force that acts on the locking pin 132 in a direction opposite to the direction of the force applied by the spring means 134 by rotation of the eccentric assembly 100; Sc represents a spring force of the spring means 144 that acts on the sliding rod 142 in a radius direction to the rotational axis 101; and Fc represents a centrifugal force that acts on the sliding rod 142 in a direction opposite to the direction of the force applied by the spring means 144 by rotation of the eccentric assembly 100.

The state illustrated in FIG. 5(*a*) shows a state in which the eccentric assembly 100 is in a start-up period, and the eccentric shaft 120 is locked by the locking device 130 and is also clamped by the clamping device 140 because of Fc<Sc and Fl<Sl, namely, Zero state mentioned through FIG. 3. Accordingly, during the start-up period of the eccentric assembly 100, the eccentric assembly 100 is in Zero state in which the eccentric moment is zero or is a very small value. Thus, since a high start-up torque is not needed, the eccentric assembly 100 is sufficiently driven even by a less powerful electrical or hydraulic motor compared to a case in which a high start-up torque is needed.

The state illustrated in FIG. 5(*b*) shows a state in which locking to the eccentric shaft 120 is maintained and clamping is released as the rotational speed of the eccentric assembly 100 further increases compared to the state illustrated in FIG. 5(*a*), thereby showing Fc>Sc and Fl<Sl. Despite the fact that the clamping is released, since the locking is still maintained, an angular position of the eccentric shaft 120 to the housing 110 does not change.

The state illustrated in FIG. 5(*c*) corresponds to Work state mentioned through FIG. 4, and shows a state in which the locking, as well as clamping to the eccentric shaft 120, are released as the rotational speed of the eccentric assembly 100 further increases compared to the state illustrated in FIG. 5(*b*), thereby showing FoSc and Fl>Sl. When the locking is released, the angular position of the eccentric shaft 120 to the housing 110 can change. Since the eccentric shaft 120 has an inertial force to maintain a stationary state, the angular position of the eccentric shaft 120 changes in a direction opposite to a rotational direction of the housing 110. In FIG. 5(*c*), the reason why the angular position of the eccentric shaft 120 changes from its original position to a counterclockwise direction is because the motor drives the eccentric assembly 100 so that the housing 110 is rotated in a clockwise direction. If the motor drives the eccentric assembly 100 so that the housing 110 is rotated in the counterclockwise direction, the angular position of the eccentric shaft 120 will change from its original position to the clockwise direction. A rotation angle of the eccentric shaft 120 to the original position is limited by the stopper 112 (see FIG. 2) installed in the housing 110. For example, the rotation angle is limited such that the eccentric moment of the eccentric assembly 100 is maximally increased, so that vibration compacting machines can effectively perform vibratory compacting. In addition, two different kinds of amplitudes of vibration can be obtained according to rotation in the counterclockwise direction and rotation in the clockwise direction.

The state illustrated in FIG. 5(*d*) shows a state in which the rotational speed of the eccentric assembly 100 further reduces compared to the state illustrated in FIG. 5(*c*), namely Work state, thereby showing FoSc and Fl<Sl. In this state, the clamping device 140 is maintained without performing clamping, and the locking pin 132 of the locking device 130 slides to be close to the rotational axis 101 so that the head part 133 comes into contact with the eccentric shaft 120. In this case, a position at which the head part 133 contacts the eccentric shaft is a position that deviates from the receiving hole 122 of the eccentric shaft 120. Accordingly, since the head part 133 and the receiving hole 122 are not fastened, the state does not show a state in which rotation of the eccentric shaft 120 is completely controlled.

The state illustrated in FIG. 5(*e*) shows a state in which the rotational speed of the eccentric assembly 100 further reduces compared to the state illustrated in FIG. 5(*d*), thereby showing Fc<Sc and Fl<Sl. Due to Fc<Sc, the clamping plate 143 of the clamping device 140 is moved to the rotational axis 101 so that the clamping plate 143 presses the eccentric shaft 120. In the state illustrated in FIG. 5(*d*), since the eccentric shaft 120 is located to be inclined with respect to the clamping plate 143, when the clamping plate 143 descends and then presses the eccentric shaft 120, the eccentric shaft 120 rotates on the rotational axis 101. During this process, the locking pin 132 is maintained in such a state that the head part 133 comes into contact with the eccentric shaft 120, and when the head part 133 is inserted into the receiving hole 122 by meeting the receiving hole 122, the rotation of the eccentric shaft 120 stops, thereby showing the same Zero state as the state illustrated in FIG. 5(*a*).

In order to stably and smoothly change the angular position of the eccentric shaft 120 with respect to the rotational axis 101 during the process of the state changes illustrated in FIGS. 5(*a*) to 5(*e*), a guide groove 123 (see FIG. 3 and FIG. 4) may be formed on an outer circumference of the eccentric shaft 120 in a circumferential direction, and a guide protrusion inserted into the guide groove 123 may be installed in the housing to correspond to the guide groove 123. Instead of the installation of a separate guide protrusion, as illustrated, the guide groove 123 may be formed on a circumference of eccentric shaft 120 passing through the receiving hole 122 so that the head part 133 of the locking pin 132 can serve as a guide protrusion.

FIGS. 6(*a*) to 6(*c*) are perspective view showing modified examples of the locking pin. As illustrated in FIG. 6, the locking pin may have various shapes. It is obvious to those having ordinary skill in the art that a shape or structure of the receiving hole 122 or the guide groove 123 or both corresponding to the locking pin can be also variously modified.

In FIGS. 5(*a*) to 5(*e*), the description is based on the case in which the clamping critical speed coc is smaller than the locking critical speed ωι̂. However, even though the clamping critical speed coc is the same as the locking critical speed col, or the clamping critical speed coc is greater than the locking critical speed col, the basic function of the eccentric assembly can be achieved, the basic function being that the eccentric moment of the eccentric assembly 100 is zero or is a very small value during the start-up period of the eccentric assembly 100, and thereafter, when the eccentric assembly 100 has a sufficient rotational speed by the completion of start-up, sufficient eccentric moment of the eccentric assembly can be provided for working. Thus, it should be deemed that the present disclosure also includes these cases.

Since the eccentric assembly 100 according to the present disclosure enables realization of Zero state in which the eccentric moment is not present or is present in a very low level during the start-up period, eccentricity of the eccentric assembly 100 does not require high start-up torque. Thus, a less powerful electrical or hydraulic motor is needed for driving of the eccentric assembly 100 compared to the case in which the eccentricity of the eccentric assembly requires high start-up torque.

Also, change of the state from Zero state to Work state or from Work state to Zero state can be performed in on-the-fly manner by changing the rotational speed of the eccentric assembly 100

Also, two amplitudes can be used by varying the rotational direction of the eccentric assembly 100.

Also, the eccentric assembly can be very simply and economically configured.

Also, it is advantageous in that the eccentric assembly 100 can be operated by only a single motor.

Although the invention has been described with reference to the preferred embodiments in the attached figures, it is noted that equivalents may be employed and substitutions made herein without departing from the scope of the invention as recited in the claims.

The invention claimed is:

1. An eccentric assembly for a vibration compacting machine, the eccentric assembly comprising:

a housing driven and rotated by a motor;

an eccentric shaft installed in the housing so as to have a changeable angular position by rotating relative to the housing;

a locking device adopted to lock the eccentric shaft by engaging with one side of the eccentric shaft, and to unlock the eccentric shaft when a rotational speed of the housing is greater than a predetermined locking critical speed ωι;

a clamping device adopted to clamp an opposite side of the one side of the eccentric shaft that engages with the locking device, and to release clamping to the eccentric shaft when a rotational speed of the housing is greater than a predetermined clamping critical speed ox; and a stopper installed in the housing so as to limit a rotation angle of the eccentric shaft generated when locking and clamping to the eccentric shaft are released.

2. The eccentric assembly of claim 1, wherein the locking device comprises: a locking pin installed to be slidable in a radius direction to a rotational axis of the housing; a spring means applying a force to the locking pin in a radius direction to the rotational axis of the housing; and a counterweight applying a force to the locking pin in a direction opposite to the direction of the force applied by the spring means using a centrifugal force generated when the housing is rotated.

3. The eccentric assembly of claim 2, wherein a head part is provided at a position corresponding to an end of the locking pin adjacent to the rotational axis, and a receiving hole is formed in the eccentric shaft so that rotation of the eccentric shaft is prevented when the receiving hole receives the head part and fastens to the head part.

4. The eccentric assembly of claim 3, wherein a guide groove corresponding to the head part of the locking pin is formed on a circumference of the eccentric shaft passing through the receiving hole.

5. The eccentric assembly of claim 1, wherein the clamping device comprises: a sliding rod installed to be slidable in a radius direction to the rotational axis of the housing; a clamping plate installed at a position corresponding to an end of the sliding rod adjacent to the eccentric shaft; a spring means applying a force to the sliding rod in a radius direction to the rotational axis of the housing; and a counterweight applying a force to the sliding rod in a direction opposite to the direction of the force applied by the spring means using a centrifugal force generated when the housing is rotated.

6. The eccentric assembly of claim 1, wherein mass distribution of the housing, the eccentric shaft, the locking device, and the clamping device is performed so that an eccentric moment has a value smaller than a predetermined value or is preferably zero in Zero state in which the eccentric shaft is locked and clamped.

7. The eccentric assembly of claim 6, wherein the stopper, which limits the rotation angle of the eccentric shaft generated when locking and clamping to the eccentric shaft are released, is the clamping plate.

8. The eccentric assembly of claim 1, wherein the clamping critical speed coc is smaller than the locking critical speed col.

9. A drum assembly comprising an eccentric assembly of claim 1.

10. A construction vehicle comprising a drum assembly of claim 9.

* * * * *